US007249581B2

(12) United States Patent
Bartsch

(10) Patent No.: US 7,249,581 B2
(45) Date of Patent: Jul. 31, 2007

(54) SYSTEM WITH CAMSHAFT AND CAMSHAFT RECEPTACLE

(75) Inventor: Guenter Bartsch, Pulheim (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/268,330

(22) Filed: Nov. 7, 2005

(65) Prior Publication Data

US 2006/0096559 A1 May 11, 2006

(30) Foreign Application Priority Data

Nov. 8, 2004 (EP) ..... 04105578

(51) Int. Cl.
*F01L 1/02* (2006.01)

(52) U.S. Cl. ..... 123/90.27; 123/90.6; 123/90.31; 123/90.38; 123/195 A; 29/888.1; 29/898.041

(58) Field of Classification Search ..... 123/90.6, 123/90.27
See application file for complete search history.

(56) References Cited

U.S. PATENT DOCUMENTS 4,383,719 A * 5/1983 Matzelle ..... 384/282
5,887,557 A * 3/1999 Battlogg ..... 123/90.17
7,069,892 B2 * 7/2006 Lechner et al. ..... 123/90.6

* cited by examiner

*Primary Examiner*—Thomas Denion
*Assistant Examiner*—Kyle M. Riddle
(74) *Attorney, Agent, or Firm*—Julia Voutyras; Allan J. Lippa

(57) ABSTRACT

The invention relates to a system, comprising a camshaft with at least two bearing points, a two-part camshaft receptacle which has, in a lower part, at least two bearing saddles and, in an upper part, at least two bearing covers corresponding to the bearing saddles, the camshaft being mounted with its bearing points in the bearing saddles and bearing covers. Further, bearing half shells are provided, of which in each case two are arranged in pairs between a bearing point and the bearing saddle and bearing cover receiving this bearing point, so that, the bearing half shells are supported on the bearing saddle or bearing cover and in each case two bearing half shells, together with a bearing point form a radial plain bearing.

7 Claims, 3 Drawing Sheets

SYSTEM WITH CAMSHAFT AND CAMSHAFT RECEPTACLE

FIELD OF INVENTION

The invention relates to an improved camshaft mounting system, and more particularly to a system with a camshaft having at least two bearing points and with a two-part camshaft receptacle which has, in a lower part, at least two bearing saddles and, in an upper part, at least two bearing covers corresponding to the bearing saddles, the camshaft being mounted with its bearing points in the bearing saddles and bearing covers.

BACKGROUND AND SUMMARY OF THE INVENTION

The operating method of a four-stroke internal combustion engine comprises the charge exchange in addition to the compression of the fuel/air mixture or of the combustion air and to the expansion as a result of the combustion taking place in the combustion space. Within the framework of the charge exchange, the expulsion of the combustion gases via the outlet valves and the filling of the combustion space with fresh mixture or fresh air by the inlet valves take place. To control the charge exchange, four-stroke engines make use almost exclusively of stroke valves which, while the internal combustion engine is in operation, execute an oscillating stroke movement and thereby carry out the operation of opening and closing the inlet and outlet ports.

The required actuation mechanism, including the valves, is designated as the valve drive. The task of the valve drive is to open and close the inlet and outlet ports of the combustion chamber in due time, the aim being to achieve a rapid opening of as large flow cross sections as possible.

For this purpose, according to the prior art, as a rule, a valve is used which can be moved along its longitudinal axis between a valve closing position and a valve open position, in order to open or shut off an inlet or outlet port of a combustion chamber of the internal combustion engine. To actuate the valve, on the one hand, valve spring means are provided in order to prestress the valve in the direction of the valve closing position, and, on the other hand, valve actuation devices are used in order to open the valve counter to the prestressing force of the valve spring means.

The valve actuation device comprises a camshaft, on which a multiplicity of cams are arranged and which is set in rotation by the crankshaft, for example by means of a chain drive, in such a way that the camshaft and, with it, the cams rotate at half the rotational speed of the crankshaft.

In this context, a basic distinction is made between an underneath camshaft and an overhead camshaft.

Underneath camshafts are suitable for the actuation of what are known as side-by-side valves, but also, with the aid of push rods and levers, for example oscillating levers or rocker levers, for the actuation of overhead valves.

By contrast, overhead camshafts are used solely for the actuation of overhead valves, a valve drive with an overhead camshaft having, as a further valve drive component, an oscillating lever, a rocker lever or a tappet. One advantage of using overhead camshafts is that, particularly by the push rod being dispensed with, the moved mass of the valve drive is reduced and the valve drive is more rigid, that is to say less elastic. The present invention relates to systems with an overhead camshaft.

When a tappet is used, the tappet is placed onto that end of the stroke valve which faces away from the combustion chamber, so that the tappet participates in the oscillating stroke movement of the valve when the cam is in engagement with the tappet.

According to the prior art, overhead camshafts are mounted in two-part camshaft receptacles, as they may be referred to. For this purpose, the camshaft has at least two bearing points. The camshaft receptacle comprises a lower part and an upper part, bearing saddles, as they are known, being provided in the lower part and bearing covers, as they are known, being provided in the upper part. In the assembled state, that is to say when the lower and the upper part of the camshaft receptacle are joined together, in each case one bearing saddle and one bearing cover form a bore for receiving and mounting the camshaft. In this case, the camshaft is received and mounted with its bearing points directly, that is to say without the introduction of any intermediate elements, in the bearing saddles and bearing covers. The bores are conventionally supplied with lubricating oil, so that, when the camshaft is rotating, a lubricating film is ideally formed between the inner face of the bore and the bearing points, in a similar way to a plain bearing.

The two parts of the camshaft receptacle are often castings which are remachined in further manufacturing steps. The bearing saddles are in this case incorporated into narrow webs which are provided in the lower part of the receptacle. These webs, and consequently also bearing saddles worked out from the webs, are very narrow, for example of the order of 1.5 to 3 millimeters. The reason for this is to be seen in that what are known as pockets or chambers, through which the tappets are inserted during assembly, have to be provided between the webs. By contrast, during remachining, the bearing covers are incorporated into the upper part of the camshaft receptacle and can be designed with a substantially greater width, for example of the order of 12 to 14 millimeters.

One disadvantage of the small width of the bearing saddles which serve for mounting the camshaft is, in particular, the low load-bearing force. When the camshaft is rotating, a lubricating film is formed between a bearing saddle and a shaft shoulder, in a similar way to a plain bearing. The load-bearing capacity of this lubricating film is codetermined critically by the width of the plain bearing or of the bearing saddle.

When the bearing force is increased, the thickness of the lubricating film decreases. With a decreasing lubricating film thickness, the fluid friction zone is left when the surface roughness of the sliding faces exceeds the lubricating film thickness. Mixed friction occurs. With a further increase in the bearing load, the fraction of solid friction increases. The destruction of the bearing, that is to say of the camshaft and of the camshaft receptacle, may occur.

The usually one-sided load on the camshaft when the internal combustion engine is in operation has a beneficial effect with regard to the small width of the bearing saddles. To be precise, the camshaft is loaded predominantly in such a way that it is pushed or pressed into or against the bearing covers.

Thus, the valve spring means act upon the valves in the direction of the valve closing position. Consequently, the valve spring means also exert forces on the camshaft via the valve tappets and the cams, an overhead camshaft being pressed into the bearing covers. Particularly when the valves are deflected during charge exchange, the return forces of the valve spring means are high. These prestressing forces are intended to prevent the cam from being lifted off from the tappet.

If, however, the camshaft is additionally used in order to actuate a fuel pump, this results in loads from the camshaft which press the camshaft into the narrow bearing saddles. This is because, for reasons of space, the fuel pump is arranged above the camshaft and is actuated by means of an additional control cam arranged on the camshaft. The control forces exerted in this case by the fuel pump on the control cam which is directed upward during the actuation of the pump are directed downward in the direction of the bearing saddle.

The loads on the bearing saddles increase, and therefore concepts have to be developed which ensure a sufficient load-bearing capacity of the lubricating film in the camshaft mounting and reduce the specific surface pressure in the bearing.

Accordingly, the disadvantages of the prior art are overcome by a system, comprising a camshaft receptacle having a lower part and an upper part, said lower part having at least two bearing saddles, said upper part having at least two bearing covers corresponding to said two bearing saddles; a camshaft having at least two bearing points, said camshaft mounted with its bearing points in the bearing saddles and bearing covers; and a bearing half shell mounted at each of said bearing points.

According to the invention, bearing half shells are provided for receiving and mounting the camshaft. In this case, after the introduction of the tappets during assembly, a bearing half shell is arranged on each bearing saddle. In a preferred embodiment, a bearing half shell is selected, the width of which exceeds the width of the narrow bearing saddle, so that the plain bearing face, formed between this bearing half shell and the bearing point, of the system according to the invention, is larger than the sliding face formed according to the prior art between the narrow bearing saddle and the bearing point.

A bearing having a substantially higher load-bearing capacity is thereby formed in the region of the bearing saddle of the camshaft receptacle. The arrangement of the bearing half shell on the web or on the bearing saddle may in this case take place separately during an individual assembly step or else, which is to be preferred, together with the camshaft which, with the bearing half shells already arranged on it, is arranged as a preassembled structural unit in the lower part of the camshaft receptacle in a single assembly step.

The rotating camshaft is in this case carried by a wide hydrodynamic lubricating oil film which is formed in the bearing point and bearing shells. The camshaft mounting according to the invention can in this case absorb higher bearing loads in the region of the bearing saddles as a result of a wider plain bearing face, without leaving the fluid friction zone. Mixed friction or high solid friction in the bearing face can be avoided.

As a result, using a system according to the present invention, a fuel pump arranged above the camshaft can easily be actuated via an additional control cam arranged on the camshaft, without there having to be the fear that the camshaft runs dry in the region of the bearing saddle.

The embodiments of the system are advantageous in which in each case the two bearing half shells provided at a bearing point are fixed with respect to the camshaft.

This makes it possible to install the camshaft, with bearing half shells already arranged on the latter in the installation position, as a preassembled structural unit. This not only reduces the number of assembly steps during assembly, but also reduces the number of individual parts to be kept in stock and to be administered and, consequently, the overall production costs.

The bearing shells are in this case fixed at least in such a way that they do not come loose from the camshaft and are not lost. Fixing may, however, be executed even more comprehensively. Thus, the bearing half shells may be fixed axially in such a way that they cannot be displaced in the direction of the longitudinal axis of the camshaft. This affords advantages, since, during assembly, the bearing shells are then positioned directly in the bearing saddles and bearing covers provided for them, without a readjustment, that is to say an axial alignment, of the shells becoming necessary. The bearing shells may also be fixed securely against twisting, so that the joint, as it is known, that is to say the region in which the two parting planes of the half shells lie opposite one another, comes to lie in a predetermined position in the circumferential direction.

The fixing, insofar as it is not detrimental to the functioning capacity of the system, may remain on the assembled system or else be removed after or during assembly. In any event, it is necessary to ensure that the camshaft can subsequently rotate or revolve during operation.

The embodiments of the system are advantageous in which the two bearing half shells are fixed at a bearing point in each case by means of a holding element. This embodiment makes it possible to fix the bearing half shells simply and quickly.

Embodiments of the system are in this case advantageous in which the holding element is a ring. A ring constructed from elastic material may in this case be pushed laterally over the bearing shells arranged on the shaft shoulder. The return forces of the ring then press the shells onto the shaft shoulder in a similar way to a spring.

Embodiments of the system are advantageous in which the holding element is a staple-shaped clip with a tong-like aperture. In contrast to the ring described above, this staple is guided radially over the shells, fixing taking place as soon as the clip engages.

Embodiments of the system are advantageous in which the holding element is produced from a strip-like material. The strip-like material may be, for example, an adhesive strip which is provided as an endless tape and a piece of which is wound around the bearing shells for fixing. A wire or a plastic cord are only two further examples of the holding element formed from a strip-like material.

Embodiments of the system are advantageous in which the holding element is connected to the bearing half shells in a materially integral manner, preferably by means of an adhesive bond. An unwanted loosening of the holding means, which would result in the fixing of the bearing half shells being canceled, can thereby be prevented.

Embodiments of the system are advantageous in which the bearing half shells have, on their outer surface area facing the camshaft receptacle, a recess in a circumferential direction for the reception of the holding element.

Embodiments of the system are advantageous in which the holding element is embedded completely in the recess.

This embodiment is advantageous because the holding elements then do not need to be removed during assembly, but can remain in the bearing shells. An additional assembly step can thus be avoided. Since the holding elements are received completely in the recess, they do not obstruct the assembly operation, that is to say the introduction of the camshaft, together with the half shells, into the camshaft receptacle. This also prevents the bearing half shells from slipping out of place during the removal of the holding means.

Embodiments of the system are also advantageous, however, in which the holding element is embedded partially in the recess and projects partially out of the recess.

The projecting part of the holding means may in this case assume various functions. For example, this part may be used to fix the shells in the bearing saddle or bearing cover, in order thereby to prevent an unwanted movement of the shells, in the axial direction or in the circumferential direction, when the camshaft is rotating. They are also suitable, however, as an assembly aid, in order to arrange the bearing shells in the intended position.

For this reason, embodiments of the system are advantageous in which the camshaft receptacle has in each case in the region of the bearing cover and/or of the bearing saddle a recess for the reception of the holding element. When the holding means engages, on the one hand, into the recess of the bearing shell and, on the other hand, into the recess of the bearing cover and/or of the bearing saddle, the shells are fixed in their position in relation to the camshaft receptacle.

The above advantages and other advantages, and features of the present invention will be readily apparent from the following detailed description of the preferred embodiments when taken in connection with the accompanying drawings, and from the claims.

BRIEF DESCRIPTION OF THE DRAWINGS

The objects and advantages described herein will be more fully understood by reading an example of an embodiment in which the invention is used to advantage, referred to herein as the Description of Preferred Embodiment, with reference to the drawings, wherein.

DESCRIPTION OF PREFERRED EMBODIMENT(S)

Figure 1:
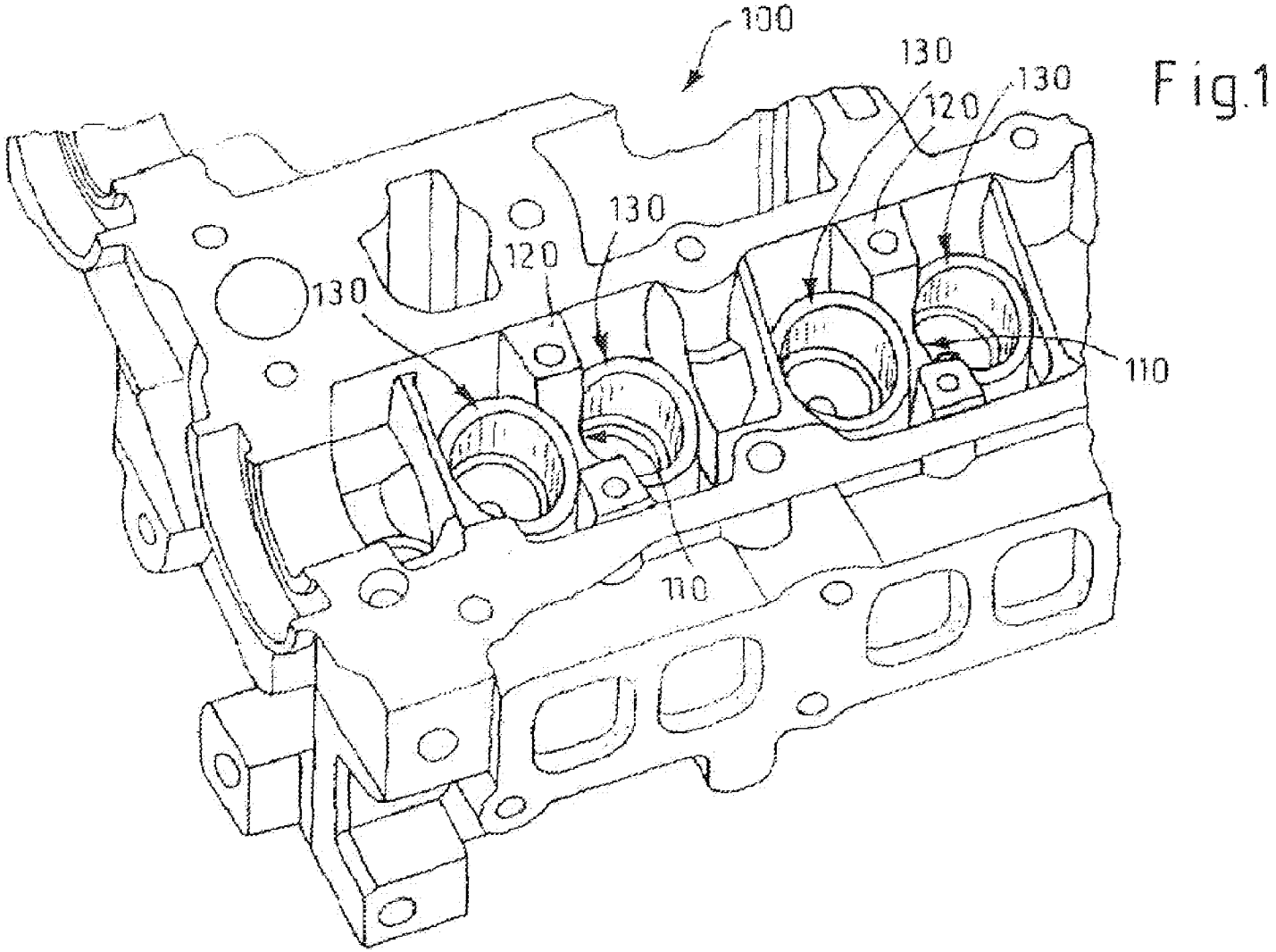
FIG. 1 shows the lower part of a camshaft receptacle according to the prior art in a side view and partially in section.

FIG. 1 shows a lower part of a camshaft receptacle 100 according to the prior art. The camshaft receptacle 100 illustrated has two bearing saddles 110 which are incorporated into two webs 120 provided in the lower part of the camshaft receptacle 100. On the right and left of the webs 120 are provided four circular pockets or chambers 130 which serve, during assembly, for providing a passage for the insertion of the tappets. The confined space conditions or the need for arranging the chambers 130 lead ultimately to the formation of very narrow bearing saddles.

Figure 2A:
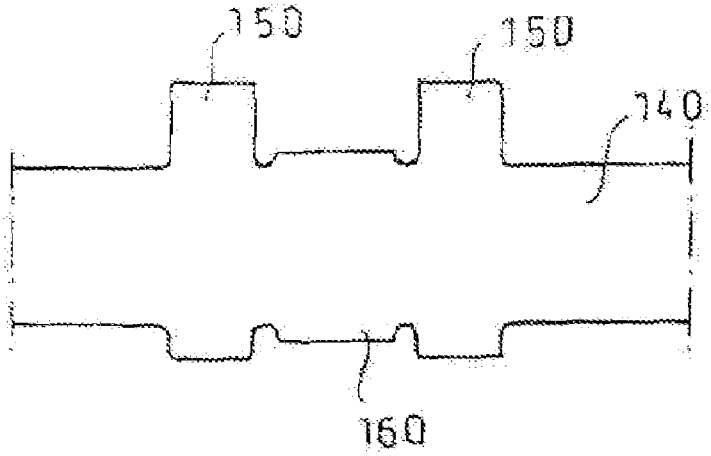
FIG. 2*a* shows diagrammatically a camshaft according to the prior art in a side view and partially in section.

FIG. 2*a* shows diagrammatically a portion of a camshaft 140 according to the prior art in a side view and partially in section.

The illustrated portion of the camshaft 140 has two cams 150, between which a thickened shaft shoulder 160 is provided. This shaft shoulder 160 serves for mounting the camshaft 140 in the camshaft receptacle and for this purpose is received (not illustrated), in the lower part of the receptacle, in a narrow bearing saddle (see also FIG. 1) and, in the upper part of the receptacle, in a bearing cover.

Figure 2B:
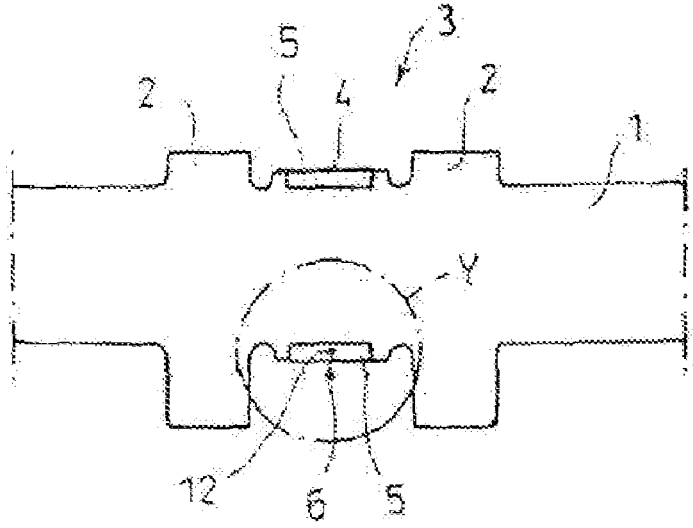
FIG. 2*b* shows diagrammatically a camshaft of the first embodiment of the system in a side view and partially in section.

FIG. 2*b* shows diagrammatically a portion of a camshaft 1 for the first embodiment of the system in a side view and partially in section.

In the portion illustrated, the camshaft 1 has two cams 2 and a shaft shoulder 3 which is arranged between these cams 2 and which serves as a bearing point 3. Arranged on the shaft shoulder 3 are two bearing half shells 5 which are fixed on the shaft shoulder 3 by a holding element 6.

The two bearing half shells 5 are equipped on their outer surface area in each case with a recess 4, 12 which runs in the circumferential direction.

The recesses serve for receiving the holding element 6, in the embodiment illustrated in FIG. 2*b* the holding element 6 being embedded completely into the recesses 4, 12 and not projecting even only partially. For this reason, the holding element 6 does not need to be removed during assembly and, since it does not obstruct the assembly operation, can remain in the recesses 4, 12.

So that the nominal diameter of the shaft shoulder 3, that is to say of the mounting, does not vary, in particular is not increased, in comparison with the conventional system (see FIG. 2*a*), a groove 7 for receiving the bearing shells 5 is provided with a shaft shoulder 3.

Figure 2C:
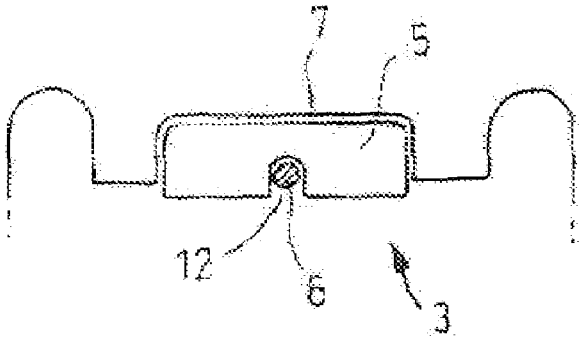
FIG. 2*c* shows the detail Y indicated in FIG. 2*b*.

FIG. 2*c* shows an enlargement of the detail Y indicated in FIG. 2*b*.

The bearing half shell 5 is positioned in a groove 7 in the shaft shoulder 3. The holding element 6 is embedded completely into a recess 12 incorporated in the bearing shaft 5.

Figure 3A:
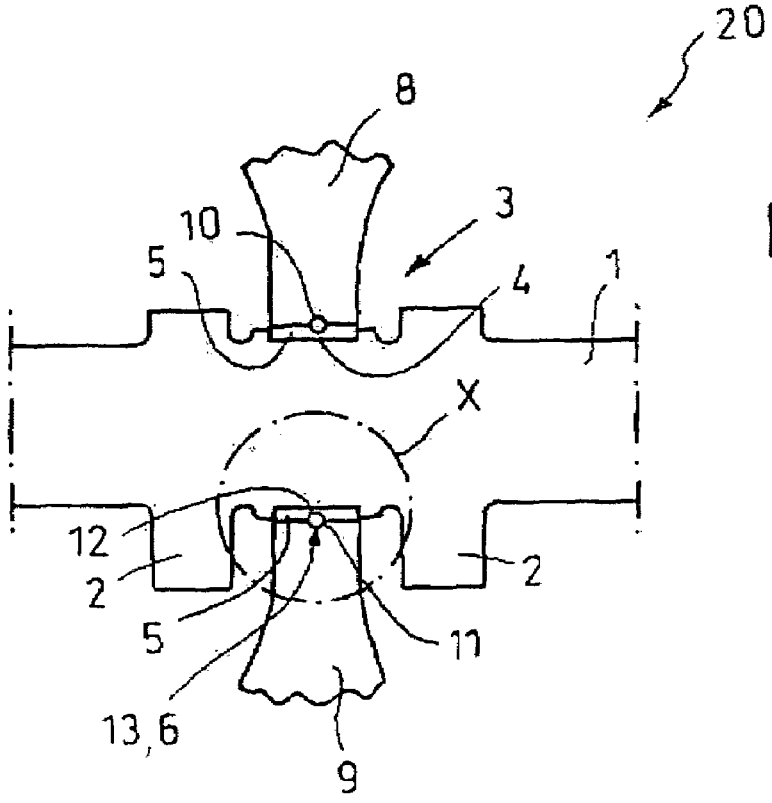
FIG. 3*a* shows diagrammatically a second embodiment of the system in a side view and partially in section.

FIG. 3*a* shows diagrammatically a second embodiment of the system in a side view and partially in section. Only the differences with respect to the first embodiment illustrated in FIGS. 2*b* and 2*c* will be discussed, and therefore reference is otherwise made to FIGS. 2*b* and 2*c*. The same reference symbols have been used for the same components.

In contrast to the first embodiment, the second embodiment illustrated in FIG. 3*a* is characterized in that the holding element 6 is embedded only partially in the recesses 4, 12 of the bearing half shells 5 and projects partially from the recesses 4, 12. The projecting part of the holding element 6 engages into the camshaft receptacle. For this purpose, the camshaft receptacle is equipped in the region of the bearing cover 8 and of the bearing saddle 9 in each case with a recess 10, 11 for receiving the holding element 6.

For this reason, after the assembly of the camshaft 1 in the camshaft receptacle, the holding element 6 serves at the same time as a fixing element 13 against axial displacement.

Figure 3B:
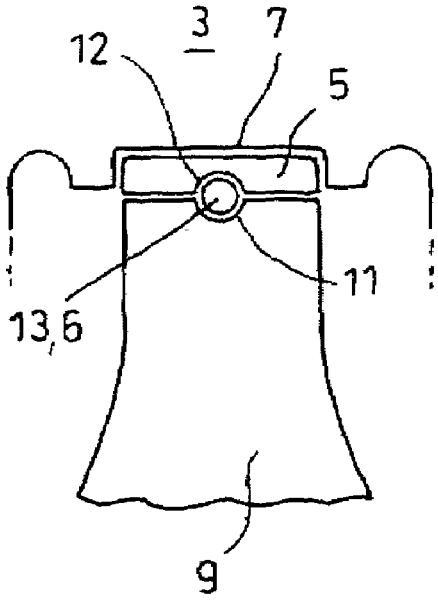
FIG. 3*b* shows the detail X indicated in FIG. 3*a*.

FIG. 3*b* shows an enlargement of the detail X indicated in FIG. 3*a*. It can be seen how the holding element 6 engages both into the recess 12 of the bearing shell 5 and into the recess 11 of the bearing saddle 9.

The invention claimed is:

1. A system, comprising:

a camshaft receptacle having a lower part and an upper part, said lower part having at least two bearing saddles, said upper part having at least two bearing covers corresponding to said two bearing saddles;

a camshaft having at least two bearing points, said camshaft mounted with its bearing points in the bearing saddles and bearing covers; and a bearing half shell mounted at each of said bearing points, wherein said bearing half shell is fixed with respect to said camshaft at a bearing point by a holding element connected to said bearing half shell by an adhesive bond, said bearing half shell further having, on its outer surface area facing the camshaft receptacle, a recess in the circumferential direction for the reception of said holding element.

2. The system as claimed in claim 1, wherein said holding element is a ring.

3. The system as claimed in claim 1, wherein said holding element is a staple shaped clip with a tong like aperture.

4. The system as claimed in claim 1, wherein the holding element is produced from a strip shaped material.

5. The system as claimed in claim 1, wherein said holding element is embedded completely in said recess.

6. The system as claimed in claim 1, wherein said holding element is embedded partially in said recess.

7. The system as claimed in claim 6, wherein said camshaft receptacle has a recess for the reception of said holding element.

* * * * *